US006982684B2

(12) United States Patent
Tsuchihashi

(10) Patent No.: US 6,982,684 B2
(45) Date of Patent: Jan. 3, 2006

(54) BRIGHTNESS COMPENSATING LOW POWER DISPLAY DEVICE AND CONTROLLER

(75) Inventor: Moriyuki Tsuchihashi, Sagamihara (JP)

(73) Assignee: International Business Machines Corporation, Armonk, NY (US)

( * ) Notice: Subject to any disclaimer, the term of this patent is extended or adjusted under 35 U.S.C. 154(b) by 328 days.

(21) Appl. No.: 10/421,966

(22) Filed: Apr. 23, 2003

(65) Prior Publication Data

US 2003/0222865 A1 Dec. 4, 2003

(30) Foreign Application Priority Data

Apr. 23, 2002 (JP) ..... 2002-121329

(51) Int. Cl.
*G09G 3/20* (2006.01)

(52) U.S. Cl. ..... 345/55; 345/77

(58) Field of Classification Search ..... 345/48, 345/55, 58, 87, 90, 92, 93, 96, 98, 99, 100, 345/204, 79, 80, 94, 95, 103, 77
See application file for complete search history.

(56) References Cited

U.S. PATENT DOCUMENTS 6,483,496 B2 * 11/2002 Kobayashi et al. ..... 345/98
6,864,866 B2 * 3/2005 Aoki ..... 345/58
2002/0158857 A1 * 10/2002 Iisaka ..... 345/204

FOREIGN PATENT DOCUMENTS

JP 2001-042838 2/2001

* cited by examiner

*Primary Examiner*—Vijay Shankar
*Assistant Examiner*—Nitin Patel
(74) *Attorney, Agent, or Firm*—Jeanine S. Ray-Yarletts

(57) ABSTRACT

Provided is a display device and the like for realizing low electric power consumption and a high image quality. A display device includes: a display panel having a plurality of pixels arranged in directions of a horizontal scanning and a vertical scanning; a driving voltage control unit for outputting to each of the plurality of pixels, a driving voltage for driving the above described pixel; and a correction unit for each of the plurality of pixels, correcting a brightness of the above described pixel depending on a position of the above described pixel in the vertical scanning direction in the display panel based on the driving voltage.

11 Claims, 5 Drawing Sheets

BRIGHTNESS COMPENSATING LOW POWER DISPLAY DEVICE AND CONTROLLER

BACKGROUND OF THE INVENTION

The present invention relates to a display device, a display controller and a display control method. In particular, the present invention relates to a power saving display device, controller and control method.

A display device is shown in which low power consumption is achieved by driving pixels with driving voltages having opposite polarities in groups of every predetermined number of lines so as to reduce the frequency of inverting voltage polarity to be applied to the pixels.

However, it has been difficult for the above described display device to display images that maintain certain image quality with respect to uniform brightness over the entire display panel.

Therefore, it is a purpose of the present invention to provide a display device, a control device or controller, and a control method which solves the above described problem. This purpose is achieved by a combination of characteristics according to the independent claims of the present invention. In addition, dependent claims define further advantageous specific examples of the present invention.

SUMMARY OF THE INVENTION

According to a first form of the present invention, a display device including: a display panel having a plurality of pixels arranged in directions of a horizontal scanning and a vertical scanning; a driving voltage control unit or controller unit, for outputting to each of the plurality of pixels, a driving voltage for driving the above described pixel; and a correction unit, for each of the plurality of pixels to be driven by the driving voltage, for correcting a brightness of the pixel depending on a position of the above described pixel in the vertical scanning direction in the display panel, and a control device and a control method for controlling the above described display device are proposed.

According to a second form of the present invention, a display device including: a display panel having a plurality of pixels arranged in directions of a horizontal scanning and a vertical scanning; a data conversion unit for generating conversion data by converting data to be displayed for each of the plurality of pixels, depending on a position of the above described pixel in the vertical scanning direction in the display panel; and a driving voltage control unit for supplying each of the plurality of pixels with a driving voltage of a size or amplitude associated with the conversion data, and a control device and a control method for controlling the above described display device are proposed.

The above summary of the invention does not enumerate all of the necessary features for the present invention, but some combinations of these features may be also inventive features.

BRIEF DESCRIPTION OF THE DRAWINGS

Some of the purposes of the invention having been stated, others will appear as the description proceeds, when taken in connection with the accompanying drawings, in which.

DETAILED DESCRIPTION OF THE ILLUSTRATIVE EMBODIMENTS

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

The present invention will be described in detail with respect to an embodiment thereof with reference to the accompanying drawings.

Figure 1:
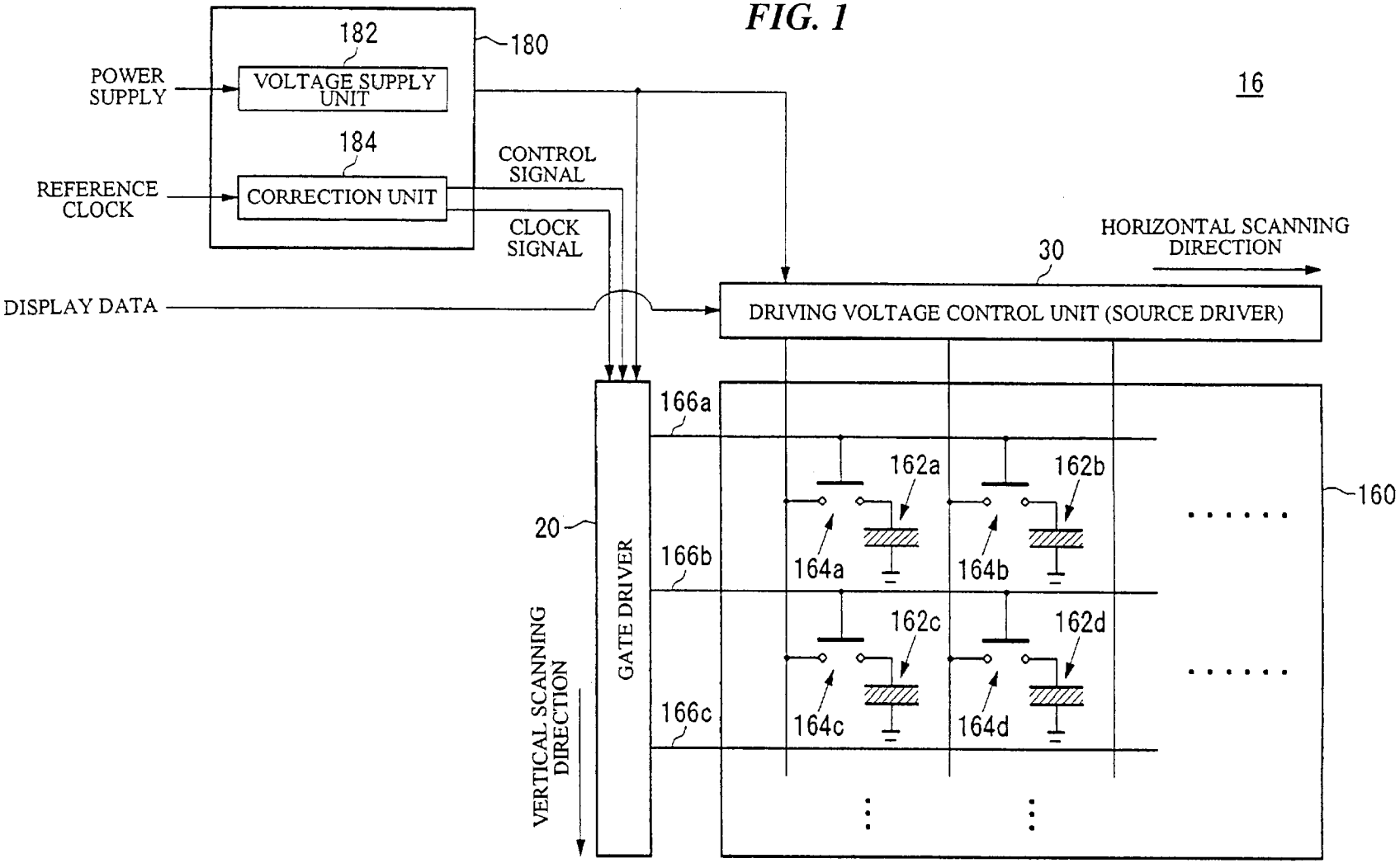
FIG. 1 is a functional block diagram of a display device 16.

Referring now more particularly to the accompanying drawings, FIG. 1 is a functional block diagram of a display device 16. The display device 16 includes a gate driver 20, a source driver 30, a display panel 160 and a control device or controller 180. The display panel 160 includes pixels 162*a–d* and transistors 164*a–d*. The control device 180 is, for example, an LSI for controlling the display panel 160, and includes a voltage supply unit 182 and a correction unit 184. The source driver 30 is an example of a driving voltage control unit according to the present invention.

The display device 16 outputs a driving voltage of a size or amplitude associated with display data in each of a plurality of pixels, in a different polarity for every two lines in the display panel 160. In this case, the display device 16 displays each pixel with a brightness which is different depending on whether the above described pixel is arranged at an odd line number or an even line number in the display panel 160. For example, even if the display device 16 receives an indication for displaying an image of a uniform brightness from a user, it displays, as a result, a striped pattern in which the brightness of the pixel arranged at the even line number and the brightness of the pixel arranged at the odd line number are different from each other. Therefore, the display device 16 may provide a uniform image quality over the entire display panel 160 by correcting the brightness of a certain pixel depending on a position of the above described pixel in a vertical scanning direction in the display panel 160.

The voltage supply unit 182 is supplied power by an external power supply, and supplies a voltage for generating the driving voltage to the gate driver 20 and the source driver 30. The correction unit 184 receives externally generated clock signal and a control signal (not shown). Then the correction unit 184 converts a cycle of the clock signal in a predetermined method. The correction unit 184 sends the converted clock signal to the gate driver 20 along with the control signal.

The pixels 162*a–d* are condensers for changing a light transmitting volume or brightness with an electric charge volume, and are associated and connected with the transistors 164*a–d*, respectively, for applying the voltage to the above described condensers. The source driver 30 receives the data to be displayed for each of the pixels 162*a–d* from outside the device, and outputs the appropriate size of driving voltage depending on the above described data. Then the gate driver 20 outputs a selection signal to the transistors 164*a–d* based on an instruction and the clock signal from the correction unit 184, and applies the driving voltage to each of the pixels 162*a–d*, respectively.

The source driver 30, for example, outputs the driving voltage depending on the data to be displayed for each pixel, for each line in the display panel 160 (for example, first the pixel 162*a* and the pixel 162*b*, and next the pixel 162*c* and the pixel 162*d*). In this case, the gate driver 20 outputs the selection signal to the transistors for each line in the display panel 160 (for example, first the transistor 164*a* and the transistor 164*b*, and next the transistor 164*c* and the transistor 164*d*) via selection signal lines 166*a–c* to apply the driving voltage to the pixel on that line and correct the brightness of the above described pixel.

Figure 2:
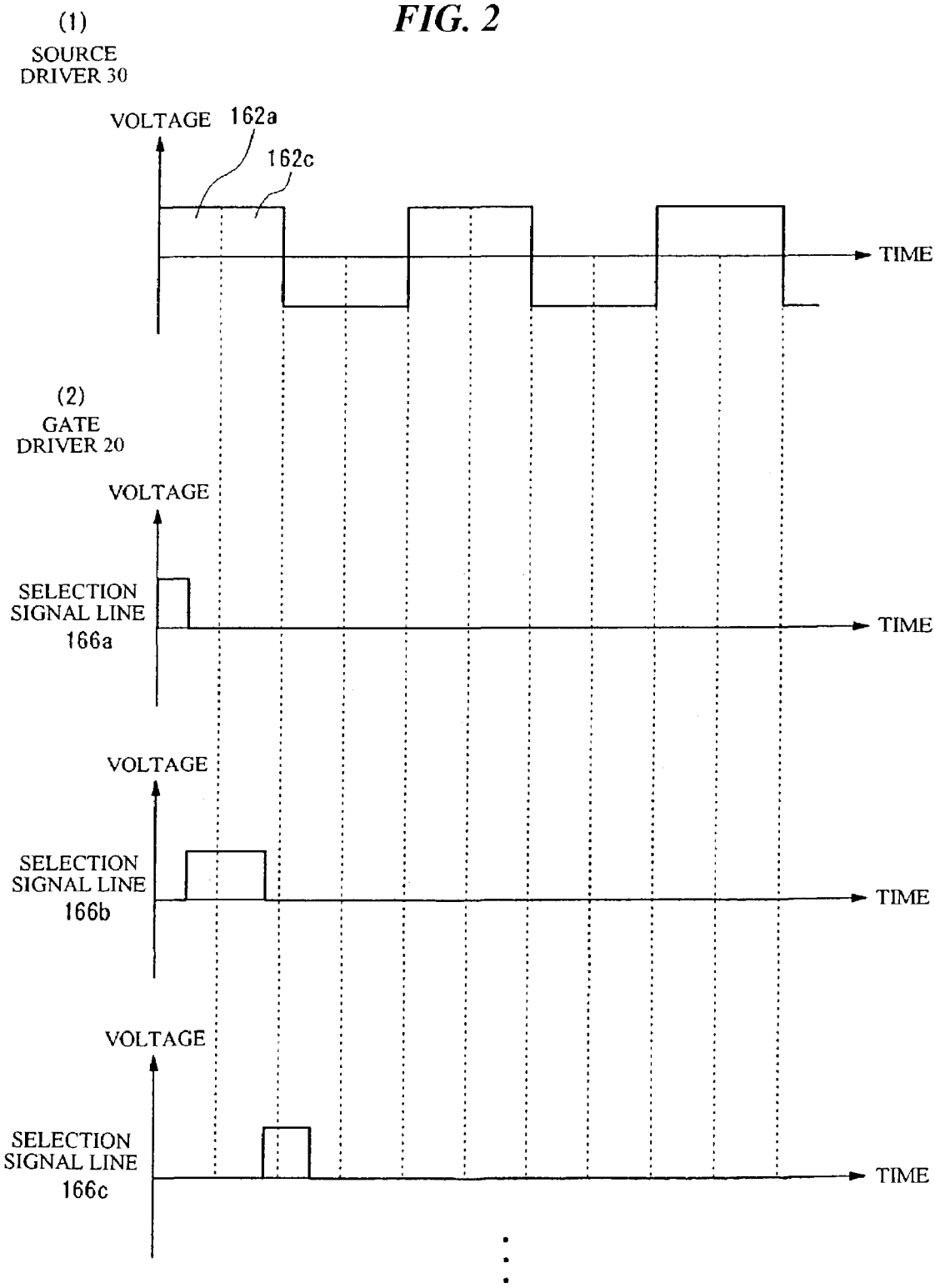
FIG. 2 shows an example of a signal outputted by a gate driver 20 and a source driver 30.

FIG. 2 shows an example of the signal outputted by the gate driver 20 and the source driver 30. In each graph shown in FIG. 2, a horizontal axis represents a time. In each graph shown in FIG. 2, a vertical axis denotes the size of the driving voltage by the selection signal from the gate driver 20 and the source driver 30. If the display device 16 receives the indication for displaying the data of the uniform brightness from outside, it outputs the driving voltage and the selection signal for applying the driving signal to the pixel as will be described below.

Figure 3:
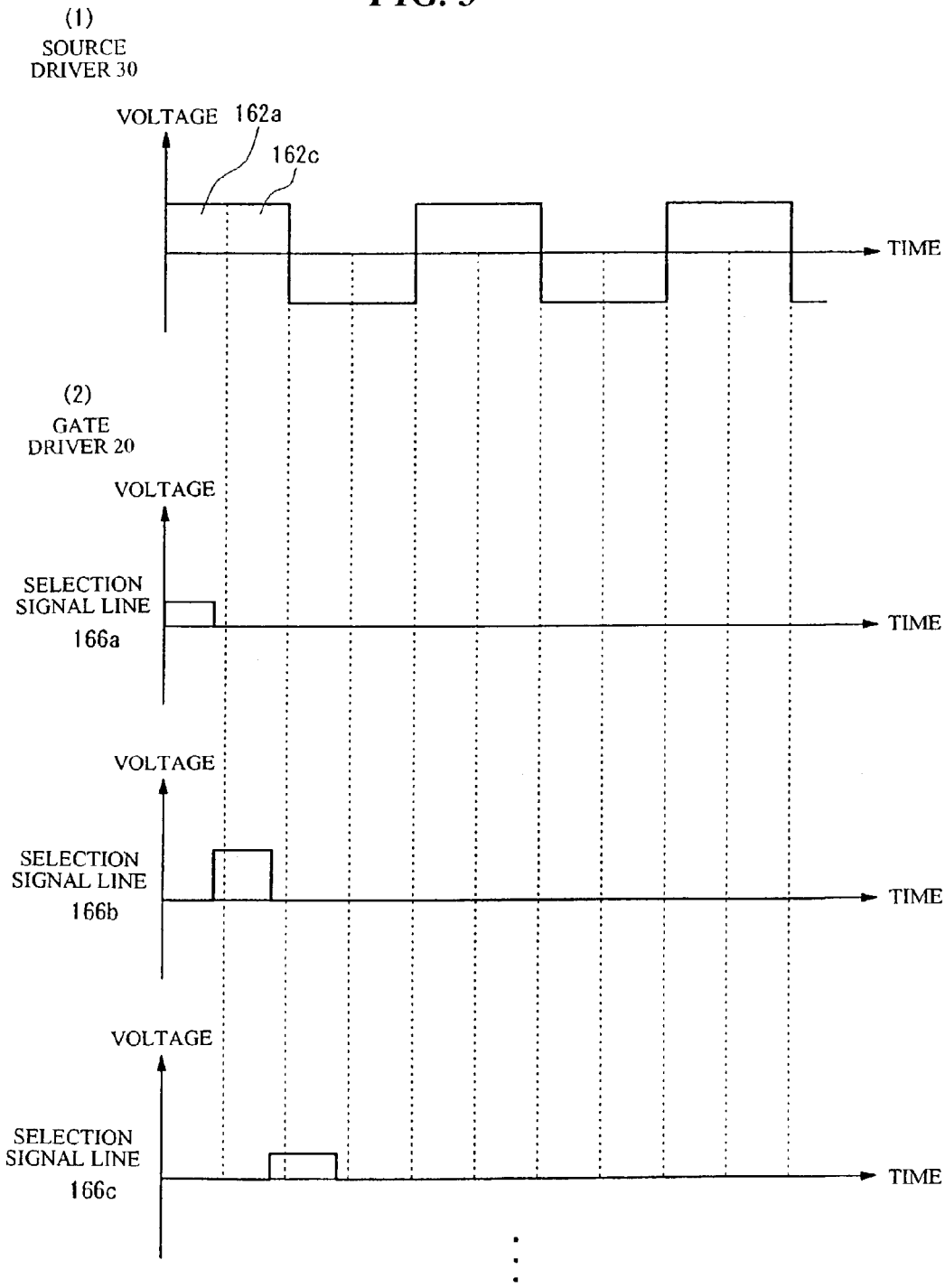
FIG. 3 shows an example of the signal outputted by a gate driver 20 and a source driver 30, in a first embodiement.

The source driver 30 outputs the driving voltage of the different polarity for every two lines as a predefined line number in the vertical scanning direction in the display panel 160 (FIG. 3(1)). For example, the source driver 30 outputs the driving voltage of a positive polarity to the pixels 162*a* and the pixel 162*c*, and outputs the driving voltage of a negative polarity to the pixels arranged subsequently in the vertical scanning direction. Then, while the driving voltage is outputted to each pixel, the gate driver 20 outputs the selection signal to the selection signal line corresponding to the position of the above described pixel in the vertical scanning direction (for example, the selection signal line 166*a* with respect to the pixel 162*a*).

Then, the brightness of the pixel is affected by the size of the driving voltage at the time when the selection signal falls. Accordingly, in order to ensure that a desired driving voltage is applied to the pixel, the gate driver 20 desirably shifts the selection signal to fall earlier than falling of the driving voltage. For example the gate driver 20 shifts the selection signal on the selection signal line 166*b* to fall earlier than the falling of the driving voltage to the pixel 162*c*.

On the other hand, the gate driver 20 may also shift a timing of rising of the selection signal by shifting the falling of the selection signal. For example, the gate driver 20 may shift the selection signal on the selection signal line 166*b* to rise earlier than starting of supplying the driving voltage to the pixel 162*c*. Thereby, the brightness of the pixel 162*c* is affected by the driving voltage to the pixel 162*a*. Here, the pixel 162*c* is affected by the driving voltage of the pixel 162*a* of the same positive polarity as the driving voltage of the above described pixel 162*c*. On the other hand, the pixel adjacent to the pixel 162*c* in the vertical scanning direction is affected by the driving voltage of the pixel 162*c* of the polarity which is different from the polarity of the driving voltage to the above described pixel. In this way, overlapping of the selection signal and the driving voltage may be different depending on whether the pixel is arranged at the odd line number or the even line number. As a result, the display device 16 displays each pixel with the brightness which is different depending on whether the pixel is arranged at the odd line number or the even line number in the display panel 160.

Therefore, the correction unit 184 outputs the clock signal whose cycle interval is periodically changed, to the gate driver 20. Then the gate driver 20 outputs the selection signal having the same width as the cycle interval of this clock signal for each line in a horizontal scanning direction in the display panel, and thereby outputs the selection signal having a width which is different depending on the position in the vertical scanning direction in a predefined line number. For example, in FIG. 2, while the gate driver 20 outputs the selection signal having a predetermined width with respect to the odd line number (for example, the transistor 164*a* via the selection signal line 166*a*), the gate driver 20 outputs the selection signal having a width which is larger than the above described width (for example, the signal having a long application time) with respect to the even line number (for example, the transistor 164*c* via the selection signal line 166*b*). That is similar with respect to the third and subsequent lines.

The correction unit 184 may output the selection signal having a waveform which is different depending on whether each of the pixels is arranged at the odd line number or the even line number in the display panel 160, as another example of correction depending on the position in the vertical scanning direction. For example, the correction unit 184 may output the selection signal having a rectangular shape to the pixel at the odd line number, and may output the selection signal having a trapezoidal shape to the pixel at the even line number. In addition, the correction unit 184 may output the selection signal with a frequency which is different depending on an arrangement position for the pixel.

In this way, the correction unit 184 may correct the brightness of the pixel depending on its position in the vertical scanning direction in the display panel 160, for example, based on a setting and the like by a manufacturer or the user. As a result, the display device 16 may correct a bias of the waveform of the driving voltage and the like, and may provide the display of the uniform brightness over the entire display panel 160.

FIG. 3 shows an example of the signal outputted by the gate driver 20 and the source driver 30, in a first embodiement. Since the functional block diagram of the display device 16 in this embodiement is approximately the same as the functional block diagram of the display device 16 in FIG. 1, the description thereof is omitted. Since the respective axes in graphs shown in FIG. 3 and FIG. 3(1) are approximately the same as those in the graphs shown in FIG. 2 and FIG. 2(1), respectively, the description thereof is omitted. If the display device 16 receives the indication for displaying the data of the uniform brightness from outside, it outputs the driving voltage and the selection signal as will be described below.

The correction unit 184 outputs the selection signal having the waveform of a height which is different depending whether each of the plurality of pixels is arranged at the odd line number or the even line number in the display panel 160, thereby corrects the brightness of the above described pixel (FIG. 3(2)). Specifically, the voltage supply unit 182 supplies the gate driver 20 with a plurality of voltages having sizes which are different from each other. Then the gate driver 20 selects these voltages alternately based on the instruction from the correction unit 184, to output the selection signal having the waveform of the height which is different depending on the position in the vertical scanning direction in the display panel 160. For example, in FIG. 3, while the gate driver 20 outputs the selection signal having the waveform of a certain height with respect to the transistor 164*a*, the gate driver 20 outputs the selection signal having the waveform of a height which is higher than the above described height with respect to the transistor 164*c*. That is similar with respect to the third and subsequent lines. In this way, in the first embodiement, the correction unit 184 may correct a deviation of the brightness due to the bias of the signal waveform of the driving voltage, by applying the driving voltage with the selection signal having the waveform of the height which is different depending on the position in the vertical scanning direction in the display panel 160, and may provide the display of the uniform brightness over the entire display panel 160.

Figure 4:
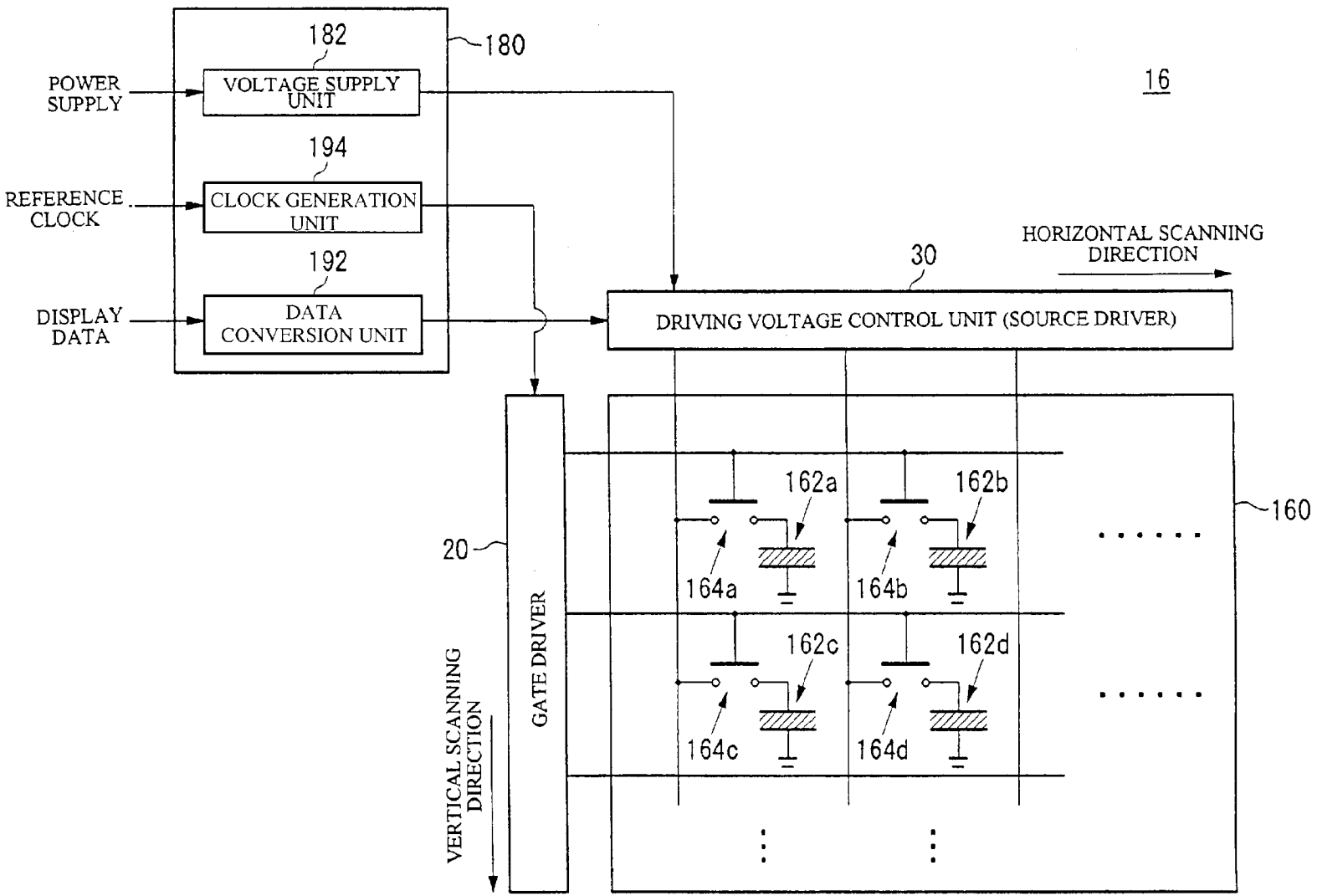
FIG. 4 is the functional block diagram of the display device 16 in a second embodiement.

FIG. 4 is a functional block diagram of the display device 16 in a second embodiement. The display device 16 in FIG. 4 is configured by excluding the correction unit 184 from the display device 16 in FIG. 1 and further adding a clock generation unit 194 and a data conversion unit 192 to the display device 16 in FIG. 1. The data conversion unit 192 receives the data to be displayed for the pixel. Then the data conversion unit 192 generates conversion data by converting the above described data depending on the position of the above described pixel in the vertical scanning direction in the display panel 160, and sends the conversion data to the source driver 30. For example, the data conversion unit 192 has a predetermined setting value (for example, 0.7) stored, and multiplies the data to be displayed for the pixel by this setting value to generate the conversion data. Then the source driver 30 supplies the driving voltage of the size associated with this conversion data to each of the pixels 162*a–d*. On the other hand, the clock supply unit 194 acquires an externally generated reference clock and generates a predetermined clock signal to output it to the gate driver 20. Since the remaining configuration is the same as FIG. 2, the description thereof is omitted.

As shown in FIG. 4, in the second embodiement, the display device 16 may convert the size of the driving voltage to be applied to each pixel by converting the data depending on the position in the vertical scanning, and may correct the brightness of the pixel.

Figure 5:
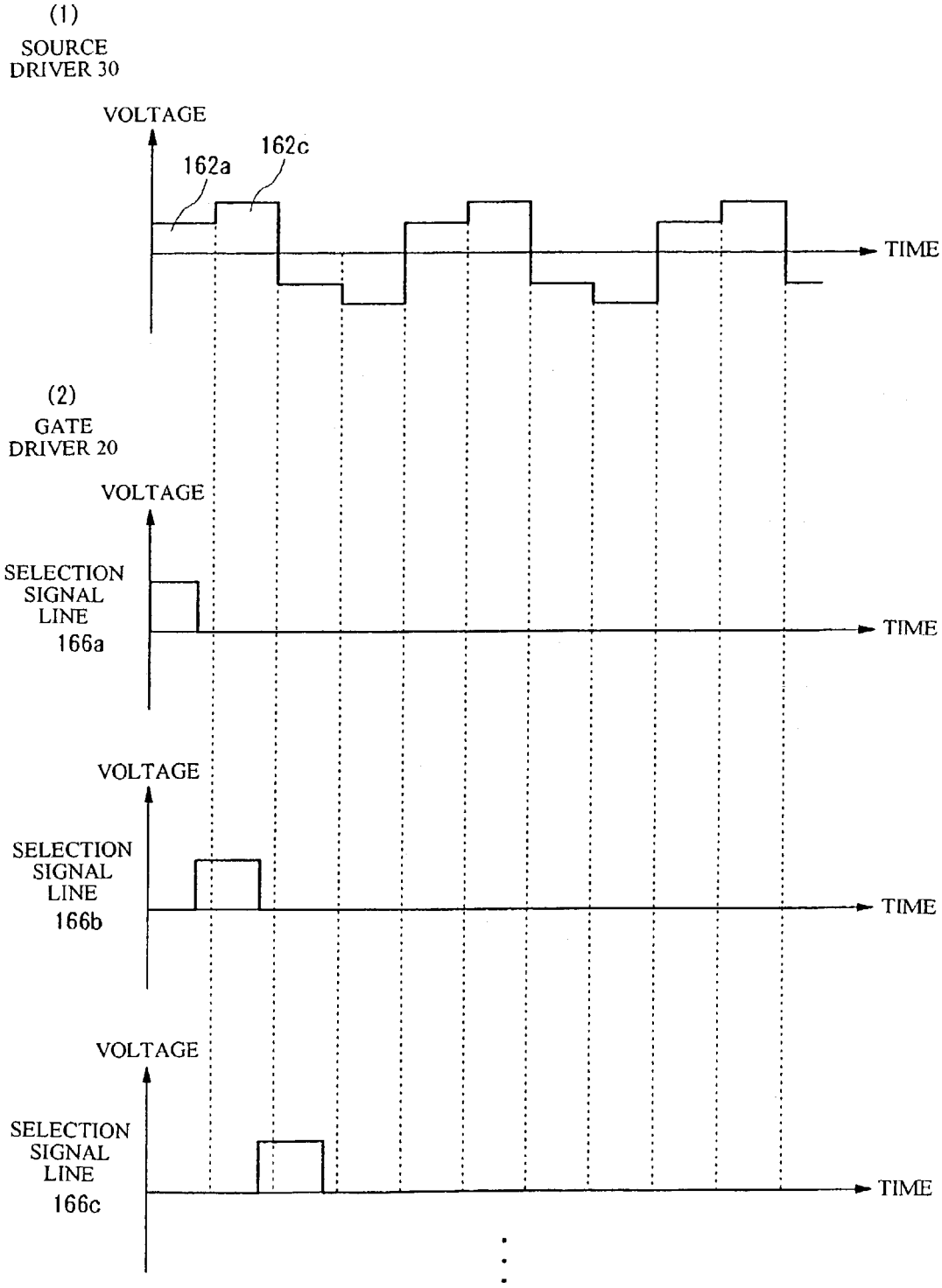
FIG. 5 shows an example of the signal outputted by a gate driver 20 and a source driver 30, in the second embodiement.

FIG. 5 shows an example of the signal outputted by the gate driver 20 and the source driver 30, in the second embodiement. Since the respective axes in graphs shown in FIG. 5 are approximately the same as those in the graphs shown in FIG. 2, the description thereof is omitted. If the display device 16 receives the indication for displaying the data of the uniform brightness, it outputs the driving voltage and the selection signal as will be described below. In FIG. 5, if the pixel to be driven is located at the odd line number in the display panel 160, the data conversion unit 192 executes a conversion of multiplying a data value by the setting value (for example, 0.7) previously stored, to generate the conversion data. On the other hand, the data conversion unit 192 does not execute the conversion with respect to the data of the pixel located at the even line number. The source driver 30, based on the conversion data received from the data conversion unit 192, outputs the driving voltage of the different polarity for every two lines as the predefined line number in the display panel 160 (FIG. 5(1)). In FIG. 5, for example, the gate driver 20 outputs the driving voltage of the size of multiplying the driving voltage to the pixel 162*c* by the predetermined setting value (for example, 0.7), to the pixel 162*a*. On the other hand, the correction unit 184 outputs the uniform selection signal regardless of the arrangement position for the pixel, by the gate driver 20 (FIG. 5(2)).

In this way, the source driver 30 may compensate the bias of the waveform of the driving voltage by outputting the driving voltage of the size which is different depending the position in the vertical scanning direction in the display panel 160, and may provide the display of the uniform brightness over the entire display panel 160.

As apparent from this embodiment, if the display device 16 outputs the driving voltage of the different polarity for every predefined line number in the display panel 160, it may provide the display of the uniform brightness over the entire display panel 160. That is, the display device 16 may lower a frequency of inverting the polarity of the driving voltage, without degrading the image quality over the entire display panel 160. Therefore, the display device 16 may reduce electric power consumption due to the low frequency of inverting the polarity of the driving voltage.

According to the embodiment described above, display devices, control devices and control methods are realized as will be described in the following respective items.

Though the present invention has been described above using the embodiment, a technical range of the present invention is not limited to a range described in the above describe embodiment. Various modifications or improvements may be added to the above described embodiment. It is apparent from the description in the claims that forms added with such modifications or improvements may also be included in the technical range of the present invention. For example, with respect to the above embodiment, the first embodiement and the second embodiement, a form in which all of them are combined and a form in which any two of them are combined are also included in the technical range of the present invention.

In the drawings and specifications there has been set forth a preferred embodiment of the invention and, although specific terms are used, the description thus given uses terminology in a generic and descriptive sense only and not for purposes of limitation. While the present invention has been described with respect to the embodiment of the invention, the technical scope of the present invention is not limited to the described embodiment. Various changes and modifications may be made in the described embodiment. As is apparent from the description in the appended Claims, modes of the present invention characterized by such changes and modifications are also included in the technical scope of the invention.

I claim:

1. An apparatus comprising:

a display panel having a plurality of pixels arranged in a horizontal scanning direction and a vertical scanning direction;

a voltage controller, coupled to said display panel, which outputs a driving voltage to each of the plurality of pixels;

said voltage controller outputting to the plurality of pixels in said display panel a different polarity of the driving voltage for every predefined line number in the vertical scanning direction; and a brightness controller, operatively coupled to said display panel, which corrects a brightness for each of the plurality of pixels dependent on the pixel's position in the vertical scanning direction in said display panel, based on a driving voltage;

said brightness controller correcting the brightness of each of the plurality of pixels depending on the position of the pixel in the predefined line number.

2. The apparatus of claim 1 wherein said brightness controller further comprises a correction unit which corrects for the brightness for each of the plurality of pixels.

3. The apparatus of claim 1 wherein, if the amplitude of the driving voltage is of the same value that is outputted to each of the plurality of pixels, said brightness controller executes a correction in which the brightness of each of the plurality of pixels becomes substantially uniform.

4. The apparatus of claim 1, wherein:

said voltage controller outputs The driving voltage of the different polarity for every two lines based upon the predefined line number; and said brightness controller, for each of the plurality of pixels, corrects the brightness of the pixel depending on whether the pixel is located at an odd line number or an even line number in said display panel.

5. The apparatus of claim 1, wherein said voltage controller is a source driver for outputting the driving voltage of an amplitude depending on data to be displayed for each of the plurality of pixels, said apparatus further comprising:

a gate driver, coupled to said display panel and said brightness controller, which corrects the brightness, based on an indication by said brightness controller, by outputting a selection signal for applying the driving voltage outputted by the source driver to the plurality of pixels.

6. The apparatus of claim 5, wherein the brightness controller further comprises:

a voltage supply which supplies said gate driver with a plurality of voltages which are different from each other;

wherein said gate driver uses the plurality of voltages supplied by said voltage supply to output the selection signal having a waveform which is different depending on the position in the vertical scanning direction.

7. The apparatus of claim 5, wherein said brightness controller outputs the selection signal which is different depending on the position in the vertical scanning direction, by outputting a dock signal whose cycle interval is periodically changed.

8. An apparatus comprising:

a display panel having a plurality of pixels arranged in a horizontal scanning direction and a vertical scanning direction;

a data controller, operatively coupled to said display panel, which generates conversion data depending on a position of the pixel in the vertical scanning direction in said display panel by converting display data for each of the plurality of pixels; and a voltage controller, operatively coupled to said display panel and said data controller, which supplies each of the plurality of pixels with a driving voltage of an amplitude associated with the conversion data;

said voltage controller outputting to the plurality of pixels in said display panel a different polarity of the driving voltage for every predefined line number in the vertical scanning direction.

9. The apparatus of claim 8, wherein said data controller further comprises: a data converter which generates conversion data depending on a position of the pixel in the vertical scanning direction for each of the plurality of pixels.

10. A method comprising the steps of:

controlling a display panel having a plurality of pixels arranged in a horizontal scanning direction and a vertical scanning direction;

outputting to each of the plurality of pixels, a driving voltage for driving the pixel, the driving voltage being of a different polarity for every predefined line numbr in the vertical scanning direction; and correcting a brightness of the pixel, for each of the plurality of pixels, depending on a position of the pixel in the vertical scanning direction in the display panel, based on the driving voltage.

11. A method comprising the steps of:

controlling a display panel having a plurality of pixels arranged in a horizontal scanning direction and a vertical scanning direction;

generating conversion data by converting data to be displayed for each of the plurality of pixels, in a manner which is different depending on a position of the pixel in the vertical scanning direction in the display panel; and supplying a driving voltage to each of the plurality of pixels of an amplitude associated with the conversion data, the driving voltage being of a different polarity for every predefined line number in the vertical scanning direction.

* * * * *